US005810114A

United States Patent [19]

White

[11] Patent Number: 5,810,114

[45] Date of Patent: Sep. 22, 1998

[54] SCAFFOLDING

[75] Inventor: Bethel Y. White, Sevierville, Tenn.

[73] Assignee: WCM Development Company, LLC, Friendsville, Tenn.

[21] Appl. No.: 811,379

[22] Filed: Mar. 4, 1997

[51] Int. Cl.[6] ..... E04G 1/14

[52] U.S. Cl. ..... 182/178.5; 182/222; 182/186.7; 182/113

[58] Field of Search ..... 182/178.5, 130, 182/222, 119, 179.1, 186.7, 113

[56] References Cited

U.S. PATENT DOCUMENTS

| | | | |
|---|---|---|---|
| 2,305,563 | 12/1942 | Uecker et al. | 304/2 |
| 2,449,069 | 9/1948 | Harrison | 304/2 |
| 2,555,782 | 6/1951 | Brownstein | 304/2 |
| 2,738,832 | 3/1956 | Torkelson | 182/222 |
| 3,726,362 | 4/1973 | Puckett | 182/178 |
| 4,391,348 | 7/1983 | Rieland | 182/119 |
| 4,430,839 | 2/1984 | Butters | 52/696 |
| 4,452,337 | 6/1984 | Atzinger | 182/178.5 |
| 4,891,926 | 1/1990 | Allenbaugh | 52/637 |
| 5,135,077 | 8/1992 | Shalder | 182/130 |
| 5,145,030 | 9/1992 | Pavlescak | 182/178.5 |
| 5,388,661 | 2/1995 | Hood, Jr. | 182/3 |
| 5,400,870 | 3/1995 | Inoue | 182/178 |
| 5,412,913 | 5/1995 | Daniels et al. | 52/79.13 |

FOREIGN PATENT DOCUMENTS

| | | | |
|---|---|---|---|
| 1197326 | 11/1959 | France | 182/45 |
| 405222832 | 8/1993 | Japan | 182/128 |

*Primary Examiner*—Alvin C. Chin-Shue
*Attorney, Agent, or Firm*—Pitts & Brittian, P.C.

[57] ABSTRACT

Improved scaffolding designed to include an integrated walk board and an integrated work board disposed above the walk board. The improved scaffolding of the present invention includes primarily a pair of end frames, a walk board, a work board, and handrail. Each end frame is configured to be common to successive scaffolding sections and includes a center post, a forward post, and a rearward post. A walk board support is mounted between the center and forward posts and work board support is mounted between the center and rearward posts at an elevation above the walk board support. Each of the walk board and work board supports is provided with a central support member on either side of which is defined a plurality of receptors configured to receive mounting studs carried by the walk board and the work board. The lower end of each post defines a receptor configured to closely receive a stud carried by the upper end of corresponding posts of a further end frame. Electrical outlets are provided at each end of the center post for powering electrical equipment. Wiring is disposed within the center post, with an outlet disposed at each end of the center post. A jumper is provided for establishing electrical communication between successive pairs of end frames. An end handrail is secured between the upper ends of the forward and center posts. A ladder is provided for ascending or descending the scaffolding. Handrail is provided on the forward and rearward sides of the scaffolding. In order to establish continuous scaffolding around corners of structures, a corner walk board and a corner work board are provided.

19 Claims, 6 Drawing Sheets

SCAFFOLDING

TECHNICAL FIELD

This invention relates to the field of scaffolding. More specifically, this invention relates to an improved scaffolding system which may be more quickly and efficiently raised and which provides greater utility than conventional scaffolding systems.

BACKGROUND ART

In the field of construction, it is well known that scaffolding is required for various stages of building structures. Scaffolding is also useful in various maintenance tasks where a substantial amount of time is required for working in elevated areas. Conventional scaffolding is used for both interior and exterior work. However, it is well known that conventional scaffolding is time-consuming to assemble and disassemble. Further, it is well known that movement within many conventional scaffolding systems is cumbersome due to the placement of cross braces. The walk boards of conventional scaffolding are typically comprised of wooden planks laid in place across the successive end frames. The dimensions and placement of such walk boards are strictly governed due to their inherent dangers caused by the overhang of each end over the end frames.

Still another problem arising from the use of conventional scaffolding is most prevalent in higher scaffolding where electrical tools are required. In such instances, electrical lines are pulled from the ground to the level at which electrical power is required. However, by having longer electrical cords dangling from electrical equipment, electrical equipment has a tendency to be pulled down, thus causing an inconvenience to the worker, potentially damaging the equipment, and creating a hazard to those at lower levels, and especially on the ground.

As indicated, many different types of scaffolding have been provided to overcome various deficiencies in conventional scaffolding. Typical of the art are those dolls and carrying devices disclosed in the following U.S. Patents:

| U.S. Pat. No. | Inventor(s) | Issue Date |
|---|---|---|
| 2,305,563 | R. A. Uecker, et al. | Dec. 15, 1942 |
| 2,449,069 | H. A. Harrison | Sept. 14, 1948 |
| 2,555,782 | R. G. Brownstein | June 5, 1951 |
| 3,726,362 | J. D. Puckett | Apr. 10, 1973 |
| 4,391,348 | R. L. Rieland | July 5, 1983 |
| 4,430,839 | G. Butters | Feb. 14, 1984 |
| 4,891,926 | D. Allenbaugh | Jan. 9, 1990 |
| 5,388,661 | R. Hood, Jr. | Feb. 14, 1995 |
| 5,400,870 | S. Inoue | Mar. 28, 1995 |
| 5,412,913 | H. F. Daniels, et al. | May 9, 1995 |

Of these patents, those disclosed by Uecker, et al. ('563); Harrison ('069); Butters ('839); Allenbaugh ('926); Inoue ('870); and Daniels, et al. ('913) are each directed to scaffolding systems which allow a worker to move from one scaffold to the next in a common level. These scaffolds are typically referred to as walk-through scaffolds, with the exception of the '913 device, which is a beam joint used in steel construction. The walk-through scaffolds are provided with walk boards as described above which overhang the supports upon which they rest. Further, these scaffolds are provided with a single surface level at each level of scaffolding, that level being provided for both walking and supporting tools and materials. None of these scaffolds provides a solution to the problems highlighted above regarding the provision of electric power at higher levels of the scaffolding.

The scaffolding disclosed by Brownstein ('782) is a box frame type structure which makes walking from one set of end frames to another difficult, due to the supports provided at each end. Further, those deficiencies discussed above are not overcome by Brownstein.

Rieland ('348) discloses a safety pin for a scaffold system for preventing the platform, or walk boards, from sliding off the supports. Rieland does not overcome the previously described deficiencies.

Finally, Hood, Jr. ('661) discloses a safety strap for use in conjunction with a scaffolding system. Hood does not disclose a new scaffolding system. Accordingly, Hood does not overcome those problems noted above.

Therefore, it is an object of this invention to provide an improved scaffolding having an integrated walk board used to secure successive pairs of end frames such that problems typically associated with walk boards are avoided.

It is another object of the present invention to provide an improved scaffolding whereby a work surface is provided at an elevation above the walk board.

Still another object of the present invention is to provide an improved scaffolding constructed such that workers may freely walk between successive sections thereof Yet another object of the present invention is to provide a means for providing electrical power to each level thereof in order to obviate the need of electrical cords being dropped from the location at which electrical equipment is being used.

A further object of the present invention is to provide an improved scaffolding having a pin mounted on the scaffolding itself in order to prevent the loss of the pin when removed.

Another object of the present invention is to provide a means whereby moving from one level of the scaffolding to another is made easier and safer over conventional scaffolding.

DISCLOSURE OF THE INVENTION

Other objects and advantages will be accomplished by the present invention which is designed to include an integrated walk board used to secure successive pairs of end frames such that problems typically associated with walk boards are avoided, with end frames being constructed such that workers may freely walk between successive sections thereof Moreover, in the preferred embodiment of the present invention, a work board is provided at an elevated location with respect to the walk board. Electrical power is provided to alleviate problems associated with dangling electric cords. Due to the configuration of the improved scaffolding, assembly and disassembly thereof is accomplished with greater efficiency when compared to the assembly and disassembly of prior art scaffolding.

Each section of the improved scaffolding of the present invention consists primarily of a pair of end frames, a walk board, a work board, and handrail. Each end frame is configured to be common to successive scaffolding sections. Each end frame includes a center post, a forward post, and a rearward post. A walk board support is mounted between the center and forward posts, at the lower ends thereof A work board support is mounted between the center and rearward posts at an elevation above the walk board support. Brace members are provided to extend between the rearward post and the work board support and between the work board support and the center post in order to form triangular configurations between the respective members. Each of the walk board and work board supports is provided with a central support member on either side of which is defined a plurality of receptors. The receptors are configured to receive mounting studs carried at the ends of each of the walk board and the work board.

The lower end of each of the forward, center and rearward posts defines a receptor configured to closely receive a stud carried by the upper end of corresponding posts of a further end frame. Accordingly, end frames are stackable in an end to end fashion in order to accomplish multi-level scaffolding. As a safety precaution, locking pins may be provided for preventing the studs from becoming dislodged from the receptors.

Electrical outlets are provided at each end of the center post for powering electrical equipment. Wiring is disposed within the center post, with an outlet disposed at each end of the center post. A jumper comprising an electrical cord having oppositely disposed male ends is provided for establishing electrical communication between successive pairs of end frames. When the bottom end frame is connected to a power source, and jumpers are attached between the end frames, each level of scaffolding is provided with electricity.

An end handrail is secured between the upper ends of the forward and center posts. The end handrail is removably mounted in a conventional manner such that it may be placed only at the ends of each run of scaffolding. By providing the end handrail only at the ends of a run of scaffolding, movement between each section of scaffolding in unencumbered.

A ladder is carried by the end frame on the center post such that a worker ascending or descending the ladder may easily access the walk board at the desired scaffold level. The ladder of the preferred embodiment is permanently mounted on the center post. However, as in the above instances, the ladder may be removable.

Handrail is provided for mounting in the lower end of the rearward posts of intermediate runs of scaffolding, on the upper end of the rearward posts on the top run of scaffolding, and on the upper ends of the forward posts of each run of scaffolding. Support braces are provided at either end to secure the hand rail and to add stability to the particular section of improved scaffolding. The support braces are pivotally mounted at one end on the handrail. A locking pin is carried by the free end of each mounting brace for being received with either the upper through opening defined by the rearward post, or the receptor defined by either of the rearward or forward posts, depending upon the disposition of the handrail. When the handrail is not in use, the locking pin carried by the mounting brace free end may be received within a receptor defined proximate the middle of the handrail. The handrail defines a mounting stud configured to be closely received within either of the through openings defined by the rearward post upper and lower ends and the forward post upper end. A pin receptor is defined at the distal end of the handrail mounting stud. The pin receptor is disposed such that when the handrail mounting stud is received within a through opening, a locking pin is received with the pin receptor, and the mounting brace locking pin is received within a through opening or receptor, the mounting brace is tensioned to bias the handrail away from the end frame.

An eye bolt is provided at the upper end of each center post for receipt of a safety cable.

In order to establish continuous scaffolding around corners of structures, a corner walk board and a corner work board are provided. Each of the corner walk board and the corner work board defines first and second ends disposed at a right angle with respect to each other. Each end, however, is configured to be substantially similar to the respective ends of the walk boards and work boards used in straight runs of scaffolding.

A locking pin typical of the present invention is provided with a securement device for permanently securing the locking pin to the end frame. The securement device includes a cable having one end mounted on the end frame in a conventional manner such as by welding, and the other end being secured to the locking pin.

BRIEF DESCRIPTION OF THE DRAWINGS

The above mentioned features of the invention will become more clearly understood from the following detailed description of the invention read tog her with the drawings in which.

BEST MODE FOR CARRYING OUT THE INVENTION

An improved scaffolding incorporating various features of the present invention is illustrated generally at 10 in the figures. The improved scaffolding 10 is designed to include an integrated walk board 74 used to secure successive pairs of end frames 12 such that problems typically associated with walk boards are avoided, with the end frames 12 being constructed such that workers may freely walk between successive sections thereof Moreover, in the preferred embodiment of the present invention, a work board 82 is provided at an elevated location with respect to the walk board 74. Electrical power is provided to alleviate problems associated with dangling electric cords. Due to the configuration of the improved scaffolding 10, assembly and disassembly thereof is accomplished with greater efficiency when compared to the assembly and disassembly of prior art scaffolding.

Figure 1:
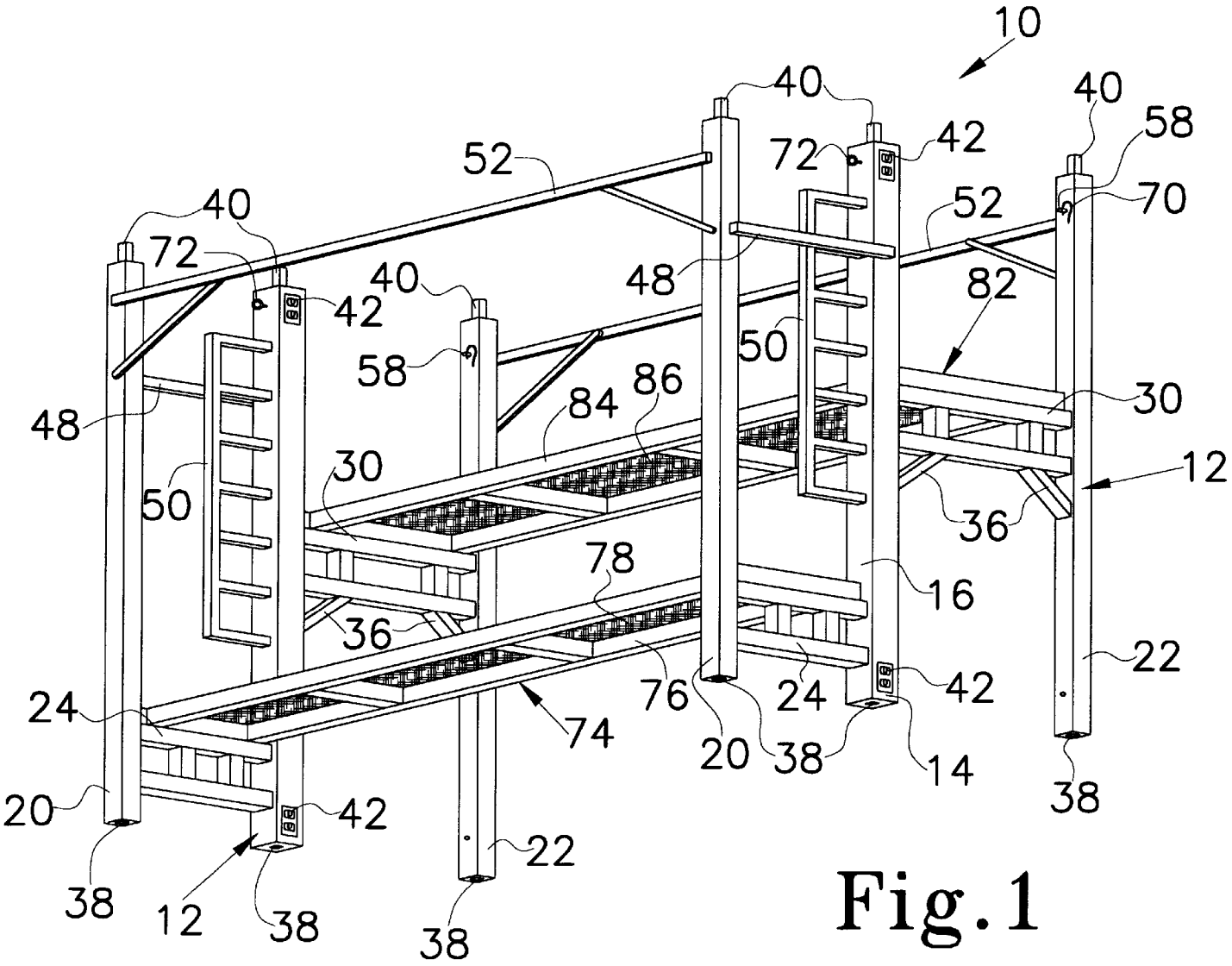
FIG. 1 is a perspective view of the improved scaffolding constructed in accordance with several features of the present invention.

Each section of the improved scaffolding 10 of the present invention consists primarily of a pair of end frames 12, a walk board 74, a work board 82, and handrail 52. Each end frame 12 is configured to be common to successive scaffolding sections. FIG. 1 illustrates, in perspective view, one section of the improved scaffolding 10 of the present invention.

Figure 2A:
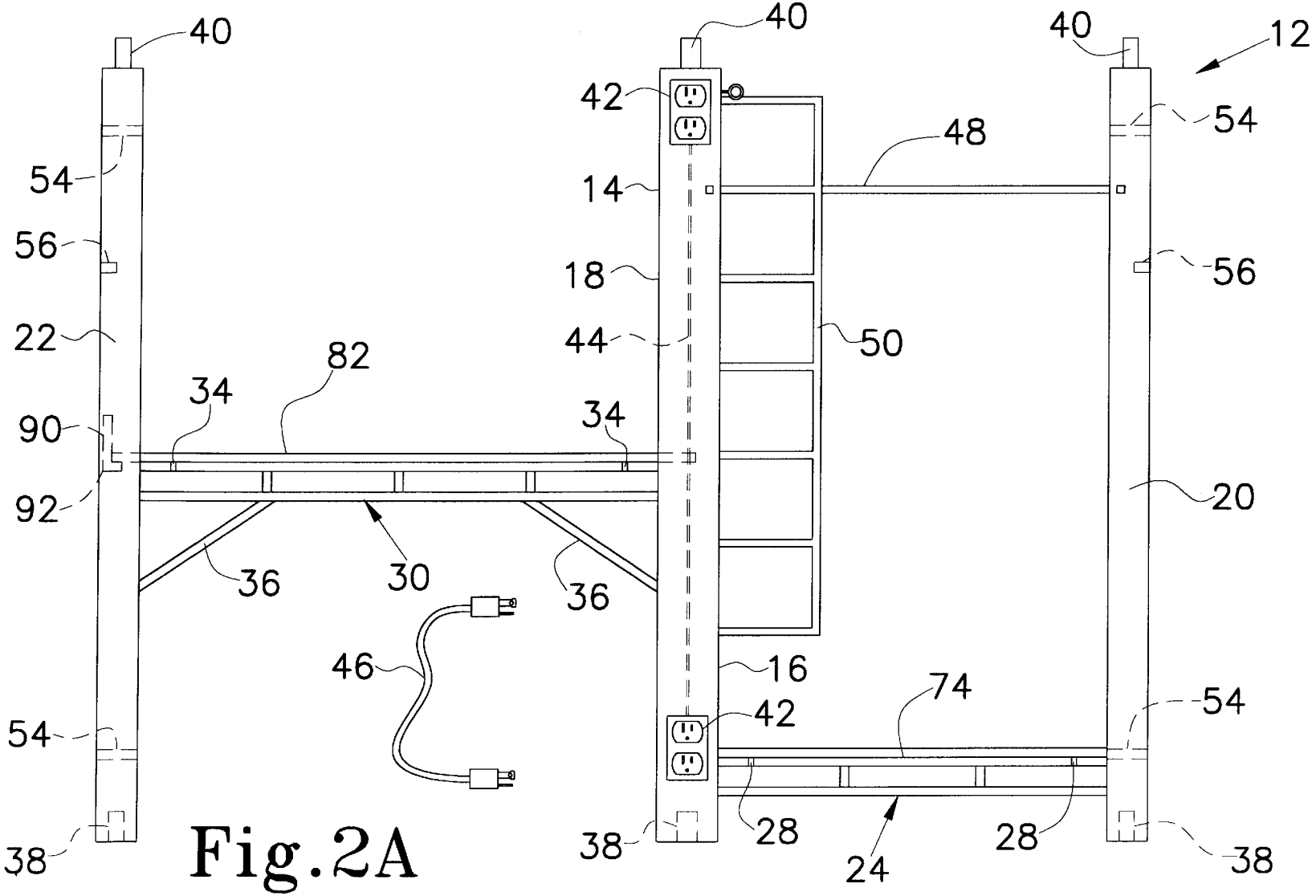
FIG. 2A illustrates an end elevation view of the improved scaffolding illustrated in FIG. 1.

As better illustrated in FIG. 2A, each end frame 12 includes a center post 14, a forward post 20, and a rearward post 22. A walk board support 24 is mounted between the center and forward posts 14,20, at the lower ends thereof A work board support 30 is mounted between the center and rearward posts 14,22 at an elevation above the walk board support 24. In the illustrated embodiment, the work board support 30 is disposed proximate the middle of the center and rearward posts 14,22. In the preferred embodiment, the walk board and work board supports 24,30 are permanently mounted between the respective forward, center and rearward posts 20,14,22. However, it will be understood that the walk board and work board supports 24,30 may be adjustable in height, thus allowing the disposition of the walk board 74 and work board 82 to be variable.

In order to provide stability of the end frame 12, brace members 36 are provided to extend between the rearward post 22 and the work board support 30 and between the work board support 30 and the center post 14 in order to form triangular configurations between the respective members. In the illustrated embodiment, the brace members 36 are permanently secured. However, it will be seen that in an embodiment as discussed above wherein the work board support 30 is adjustable, the brace members 36 must be adjustable as well. It will further be seen that the brace members 36 may be disposed in similar fashion below the walk board support 24 in addition to, or in lieu of, the illustrated brace members 36.

The lower end of each of the forward, center and rearward posts 20,14,22 defines a receptor 38 configured to closely receive a stud 40 carried by the upper end of corresponding posts 20,14,22 of a further end frame 12. Accordingly, end frames 12 are stackable in an end to end fashion in order to accomplish multi-level scaffolding. As a safety precaution, locking pins may be provided for preventing the studs 40 from becoming dislodged from the receptors 38.

Electrical outlets 42 are provided at each end of the center post 14 for powering electrical equipment. In the illustrated embodiment, wiring 44 is disposed within the center post 14, with a pair of outlets 42 disposed at each end of the center post 14. A jumper 46 comprising an electrical cord having oppositely disposed male ends is provided for establishing electrical communication between successive pairs of end frames 12. When the bottom end frame 12 is connected to a power source, and jumpers 46 are attached between the end frames 12, an outlet 42 disposed at each of the upper and lower ends of each end frame 12 is provided with electricity.

An end handrail 48 is secured between the upper ends of the forward and center posts 20,14. In the preferred embodiment, the end handrail 48 is removably mounted in a conventional manner such that it may be placed only at the ends of each run of scaffolding 10. By providing the end handrail 48 only at the ends of a run of scaffolding 10, movement between each section of scaffolding 10 in unencumbered. However, it will be seen that the end handrail 48 may be permanently mounted to each end frame 12 in a conventional manner.

Figure 2B:
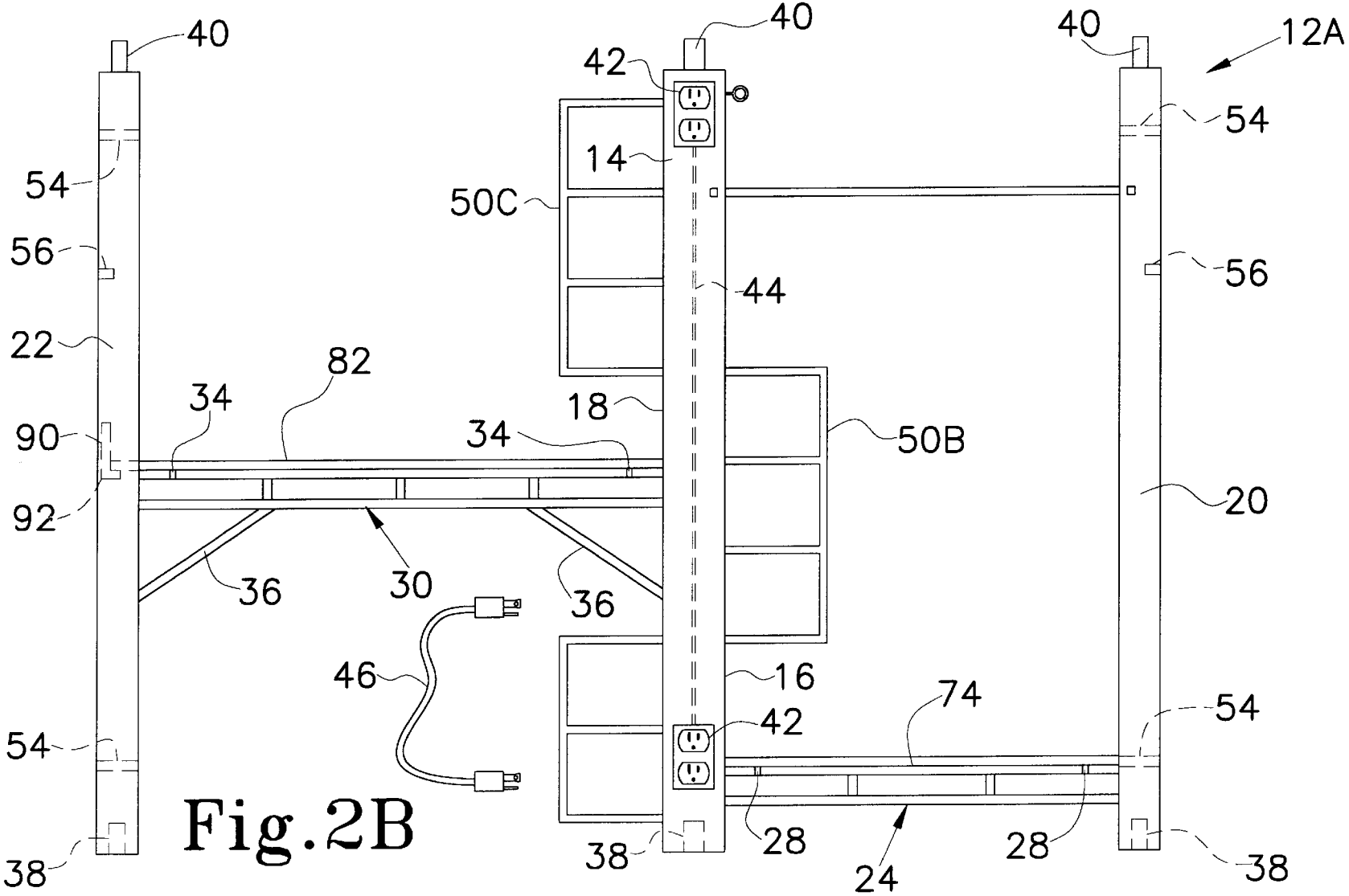
FIG. 2B illustrates an end elevation view of an alternate embodiment of the present invention.

A ladder 50 is carried by the end frame 12, preferably on the center post 14 such that a worker ascending or descending the ladder 50 may easily access the walk board 24 or work board 30 at the desired scaffold level. The ladder 50 of the preferred embodiment is permanently mounted on the center post 14. However, as in the above instances, the ladder 50 may be removable. As illustrated in FIG. 2B, the ladder 50 in an alternate embodiment includes a first ladder portion 50A carried on the rearward side 18 of the center post 14 below the work board support 30, a second ladder portion 50B carried on the forward side 16 of the center post 14 above the first ladder portion 50A, and a third ladder portion 50C on the rearward side 18 of the center post 14 above the second ladder portion 50B.

As will be discussed in more detail below, the lower end of the rearward post 22 defines a through opening 54 for mounting handrail 52 on intermediate layers of scaffolding 10. A through opening 54 is also defined at the upper end of the rearward post 22 for mounting a support brace 62 associated with a handrail 52 mounted to the intermediate runs of scaffolding 10, or for mounting a handrail 52 on the top run of scaffolding 10. A receptor 56 is defined a distance below the upper through opening 54 for mounting a support brace 62 associated with the handrail 52 on the top run of scaffolding 10. The spacing between the upper through opening 54 and the receptor 56 is equal to the spacing between the lower through opening 54 on a first end frame 12 and the upper through opening 54 on a second end frame 12 disposed immediately below the first. An upper through opening 54 and a receptor 56 are also defined by the upper end of the forward post 20 for mounting handrail 52 on each run of scaffolding 10.

An eye bolt 72 is provided at the upper end of each center post 14 for receipt of a safety cable (not shown). The safety cable is threaded through each eye 72 bolt along a run of scaffolding 10. Workers are then tethered to the safety cable in a conventional manner. By disposing the eye bolt 72 at an upper end of the center post 14, the worker wearing a harness tethered to the safety line is less likely to become entangled.

Figure 4:
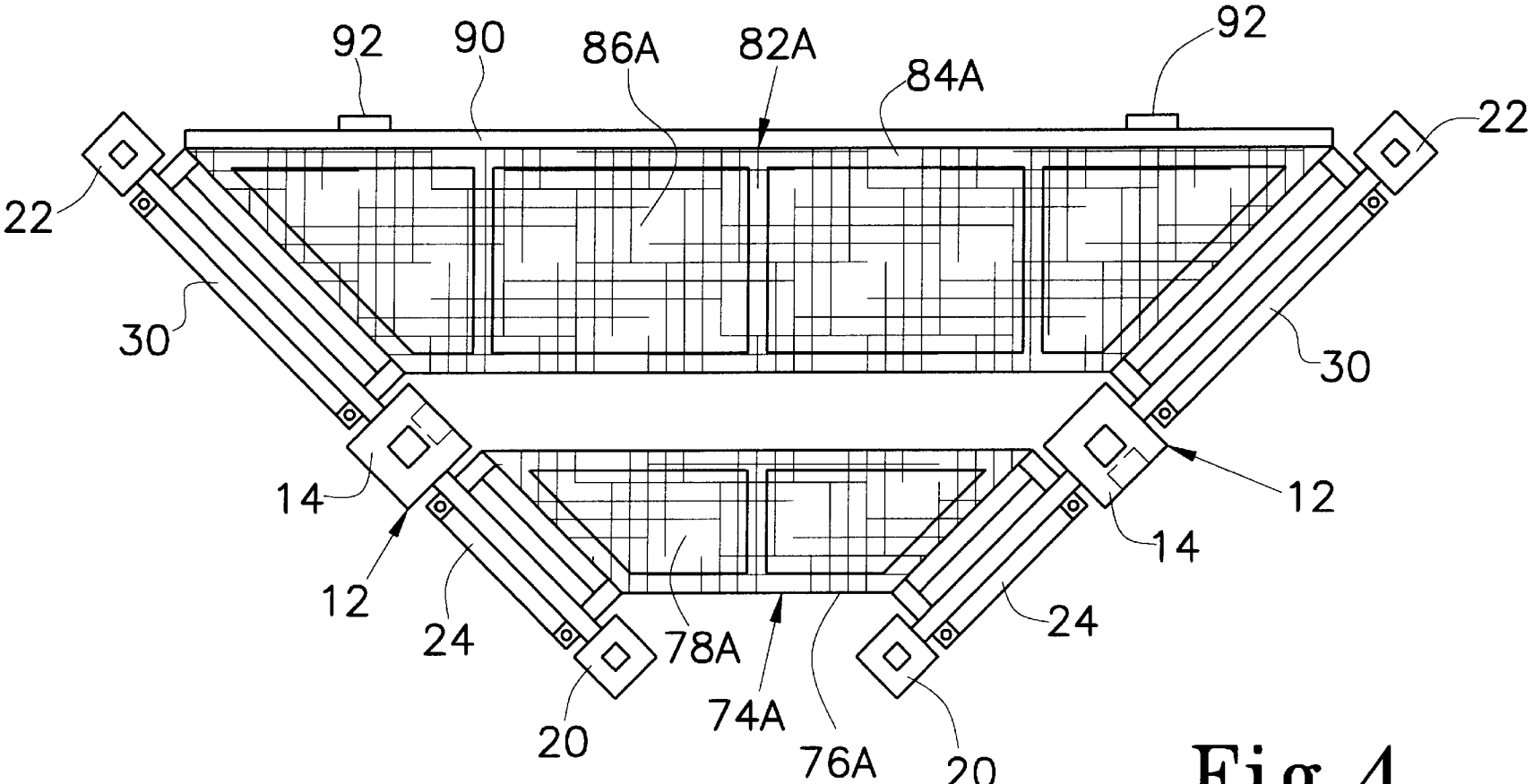
FIG. 4 is a top plan view of the improved scaffolding illustrating a corner walk board and work board.

The walk board 74 and the work board 82 are each constructed in similar fashion to each other. In the illustrated embodiment, each includes a frame 76,84 constructed from a tubular steel and a support surface 78,86 fabricated from a selected grating material. A toe board 90, best illustrated in FIG. 4, is provided for attachment to the rearward side of the work board 82, thus providing a means for preventing items from being pushed off of the work board 82. As illustrated in FIG. 4, the toe board 90 is mounted on the work board 82 in a conventional manner such as by clamping. A handrail (not shown) may also be mounted to the work board using the clamps 92 shown to mount the toe board 90.

Figure 3:
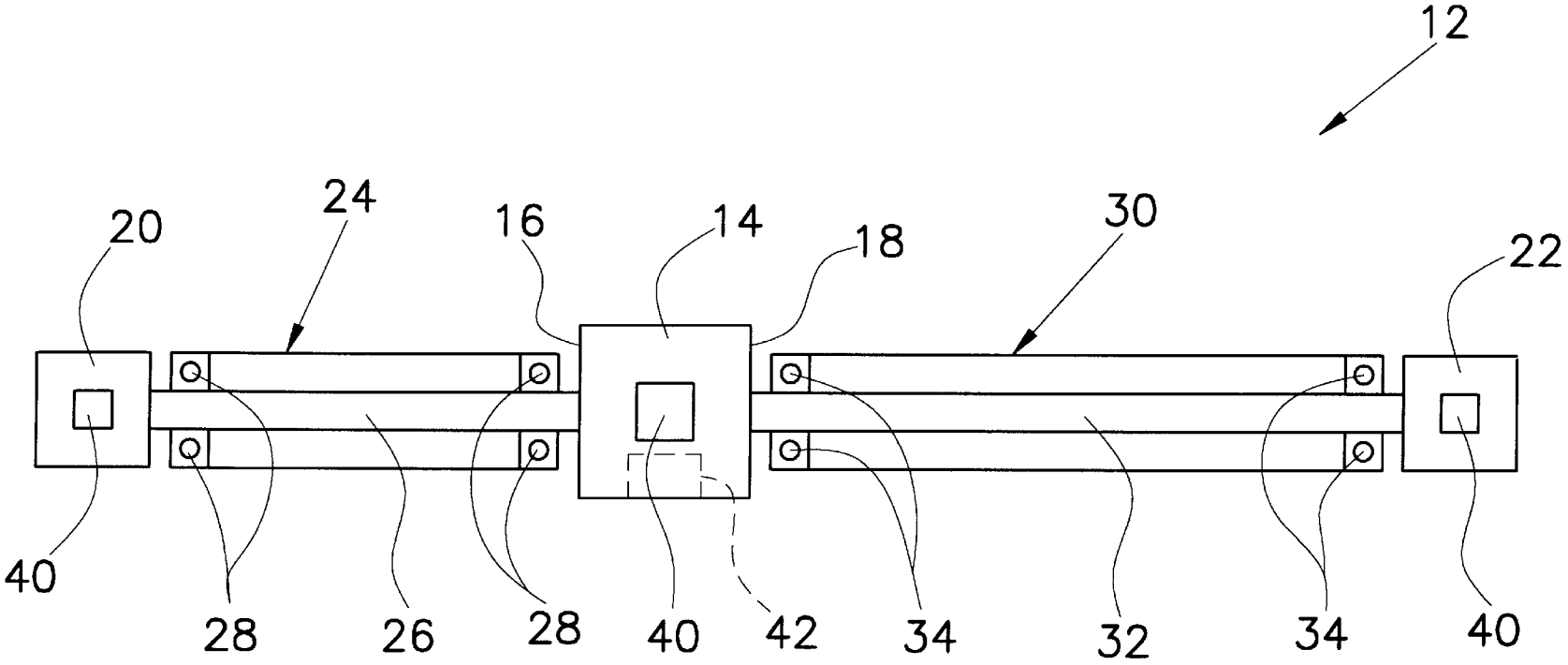
FIG. 3 is a top plan view of the end frame of the improved scaffolding of FIG. 1.

FIG. 3 is a top plan view of the end frame 12 of the present invention. As can be seen more clearly in this figure, each of the walk board and work board supports 24,30 is provided with a central support member 26,32 on either side of which is defined a plurality of receptors 28,34. The receptors 28,34 are configured to receive mounting studs 80,88 carried at the ends of each of the walk board 74 and the work board 82. From this construction, it can be seen that assembly and disassembly of the improved scaffolding 10 of the present invention is performed quickly and efficiently. Although several methods may be followed to assemble the improved scaffolding 10, one preferred method is to secure one end of a walk board 74 to a walk board support 24 of one end frame 12. Then the other end of the walk board 74 is secured to the walk board support 24 of a second end frame 12. A work board 82 is then secured at either end to the respective work board supports 30 of the two end frames 12. Locking pins 68 are put in place where required. Handrail 48,52 is then mounted as required.

In order to establish continuous scaffolding 10 around corners of structures, a corner walk board 74A and a corner work board 82A are provided, as illustrated in FIG. 4. Each of the corner walk board 74A and the corner work board 82A defines first and second ends disposed at a right angle with respect to each other. Each end, however, is configured to be substantially similar to the respective ends of the walk board 74 and work board 82 illustrated in FIG. 1. Although not shown, the corner walk board 74A and work board 82A may be adjustable to accommodate for varied spacing of the straight runs of scaffolding to which they attach. Adjustment of the length of the corner walk board 74A and corner work board 82A is accomplished by constructing each to include two telescoping members.

Figure 5:
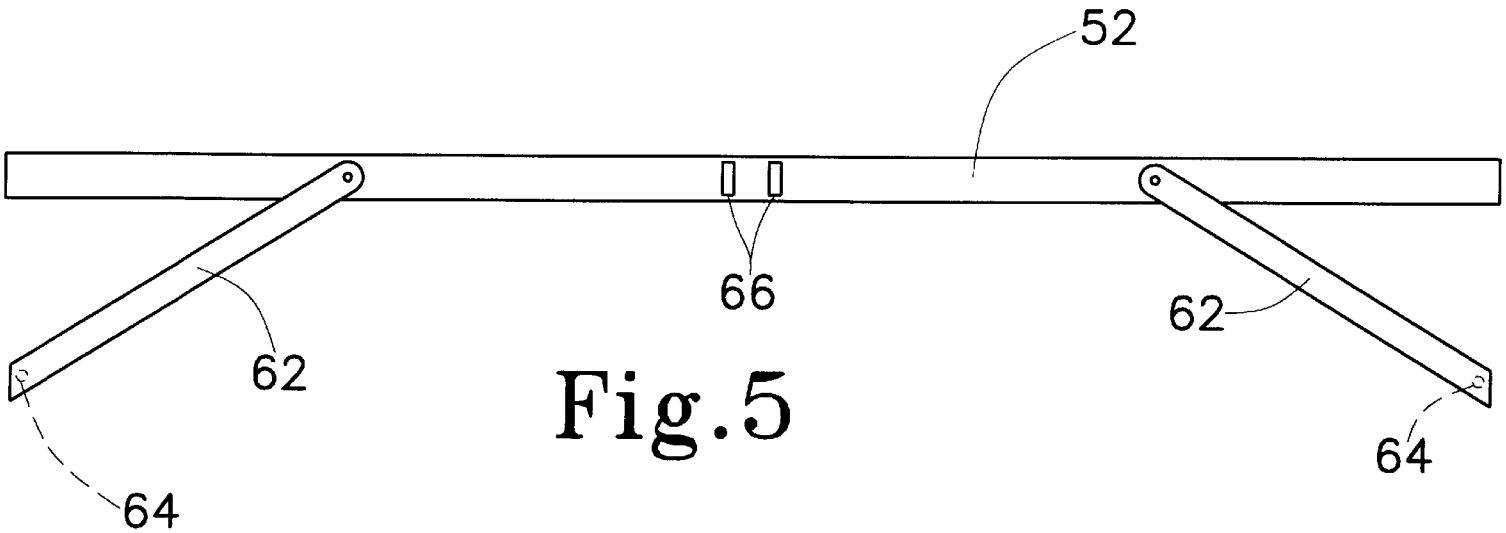
FIG. 5 is a front elevation view of a handrail used in conjunction with the improved scaffolding of FIG. 1.

FIG. 5 more clearly illustrates the handrail 52 mounted at the upper end of the top run of scaffolding 10 on the rearward posts 22, at the lower end of each intermediate run of scaffolding 10 on the rearward posts 22, and at the upper end of each run of scaffolding 10 on the forward posts 20. The support braces 62 are pivotally mounted at one end on the handrail 52 as shown. A locking pin 68 (see FIG. 6) is carried by the free end of each mounting brace 62 for being received within either the upper through opening defined by the rearward post 22 or the receptor 56 defined by either of the rearward or forward posts 22,20, depending upon the disposition of the handrail 52. When the handrail 52 is not in use, the locking pin 64 carried by the mounting brace 62 free end may be received within a receptor 66 defined proximate the middle of the handrail 52.

Figure 6:
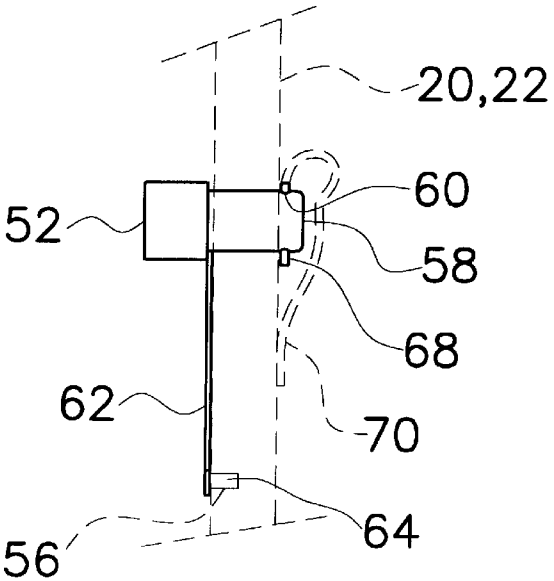
FIG. 6 is an end elevation view of the handrail of FIG. 5 more clearly illustrating the connection thereof to an end frame.

As can be more clearly seen in FIG. 6, the handrail 52 defines a mounting stud 58 configured to be closely received within either of the through openings 54 defined by the rearward post 22 upper and lower ends and the forward post 20 upper end. A pin receptor 60 is defined at the distal end of the handrail mounting stud 58. The pin receptor 60 is disposed such that when the handrail mounting stud 58 is received within a through opening 54, a locking pin 68 is received with the pin receptor 60, and the mounting brace locking pin 64 is received within a through opening 54 or receptor 56, the mounting brace 62 is tensioned to bias the handrail 52 away from the end frame 12. In so doing, the handrail 52 is prevented from unselected movement with respect to the end frames 12.

Also illustrated in FIG. 6 is a locking pin 64 typical of the present invention. The locking pin 64 is provided with a securement device 70 for permanently securing the locking pin 64 to the end frame 12. In the illustrated embodiment, one end of a cable is mounted on the end frame 12 in a conventional manner such as by welding, with the other end of the cable being secured to the locking pin 64. It will be seen that other embodiments of the securement device 70 may be incorporated as well. By providing a securement device 70 such as that described, it will be seen that the locking pins 64 do not get lost, which is the tendency in conventional scaffolding systems.

From the foregoing description, it will be recognized by those skilled in the art that improved scaffolding offering advantages over the prior art has been provided. Specifically, the improved scaffolding provides an integrated walk board and an integrated work board at an elevated level with respect to the walk board. The improved scaffolding is also designed to allow workers to freely walk between successive sections thereof Electrical power is provided to alleviate problems associated with dangling electric cords. Due to the configuration of the improved scaffolding, assembly and disassembly thereof is accomplished with greater efficiency when compared to the assembly and disassembly of prior art scaffolding.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

I claim:

1. Improved scaffolding comprising:

a plurality of end frames, each said end frame including:

a center post, a forward post, and a rearward post, a lower end of each of said forward post, said center post and said rearward post defining a receptor configured to closely receive a stud carried by an upper end of each of said forward post, said center post and said rearward post of a further end frame;

a walk board support mounted between and proximate said lower end of said center post and said forward post, said walk board support defining a central support member extending from said center post to said forward post, a plurality of receptors being defined on both side of said central support;

a work board support mounted between and proximate a middle of said center post and said rearward post at an elevation above said walk board support, said work board support defining a central support member extending from said center post to said rearward post, a plurality of receptors being defined on either side of said central support;

an end handrail removably secured between an upper end of said forward post and an upper end of said center post; and at least one side handrail, said rearward post and said forward post each defining at least one through opening for closely receiving a mounting stud carried by each of said side handrail, said mounting stud defining a pin receptor at a distal end thereof for receiving a locking pin, said side handrail including at least one mounting brace pivotally secured at a proximal end thereof to said side handrail, said mounting brace defining a locking pin at a distal end thereof, said rearward post and said forward post each defining at least one receptor for closely receiving said mounting brace locking pin, a plurality of walk boards, each said walk board defining a plurality of mounting studs at a proximal end and a distal end thereof, said plurality of mounting studs being disposed and configured to be closely received within said plurality of receptors defined by said walk board support; and a plurality of work boards, each said work board defining a plurality of mounting studs at a proximal end and a distal end thereof, said plurality of mounting studs being disposed and configured to be closely received within said plurality of receptors defined by said work board support.

2. The improved scaffolding of claim 1 wherein said walk board support is permanently secured to said forward post and said center post, and wherein said work board support is permanently secured to said center post and said rearward post.

3. The improved scaffolding of claim 1 wherein said walk board support is removably secured to said forward post and said center post, and wherein said work board support is removably secured to said center post and said rearward post.

4. The improved scaffolding of claim 1 wherein at least one end frame further includes a first brace member secured between said rearward post and said work board support and a second brace member secured between said work board support and said center post.

5. The improved scaffolding of claim 1 wherein at least one end frame further includes at least one electrical outlet carried by said center post, electrical wiring being disposed within said center post for electrical communication between said at least one outlet and a power source.

6. The improved scaffolding of claim 5 wherein said electrical wiring terminates at an upper end and a lower end of said center post with one each of said at least one electrical outlet, said improved scaffolding further comprising at least one electrical jumper configured to connect said electrical wiring of one said end frame center post with another said end frame center post in order to establish electrical communication therebetween.

7. The improved scaffolding of claim 1 wherein at least one end frame further includes a ladder carried by said center post.

8. The improved scaffolding of claim 1 wherein said side handrail mounting stud pin receptor is disposed such that when said handrail mounting stud is received within said through opening, said locking pin is received with said pin receptor, and said mounting brace locking pin is received within said mounting brace locking pin receptor, said mounting brace is tensioned to bias said side handrail away from said end frame.

9. The improved scaffolding of claim 1 wherein said rearward post defines one said through opening at each of said upper end and said lower end thereof and wherein said forward post defines one said through opening proximate said upper end thereof, said side handrail being removably securable at each said through opening.

10. The improved scaffolding of claim 1 wherein at least one end frame further includes an eye bolt carried at said upper end of said center post for receipt of a conventional safety cable.

11. The improved scaffolding of claim 1 wherein said walk board proximal end and said walk board distal end are disposed in parallel relationship one with another, and wherein said work board proximal end and said work board distal end are disposed in parallel relationship one with another.

12. The improved scaffolding of claim 1 wherein said walk board proximal end and said walk board distal end are disposed at a right angle with respect to each other, and wherein said work board proximal end and said work board distal end are disposed at a right angle with respect to each other.

13. Improved scaffolding comprising:

a plurality of end frames, each said end frame including:

a center post, a forward post, and a rearward post, a lower end of each of said forward post, said center post and said rearward post defining a receptor configured to closely receive a stud carried by an upper end of each of said forward post, said center post and said rearward post of a further end frame;

a walk board support mounted between and proximate said lower end of said center post and said forward post, said walk board support defining a central support member extending from said center post to said forward post, a plurality of receptors being defined on either side of said central support;

a work board support mounted between and proximate a middle of said center post and said rearward post at an elevation above said walk board support, said work board support defining a central support member extending from said center post to said rearward post, a plurality of receptors being defined on both side of said central support;

a first brace member secured between said rearward post and said work board support and a second brace member secured between said work board support and said center post;

an end handrail removably secured between an upper end of said forward post and an upper end of said center post, at least one side handrail, said rearward post and said forward post each defining at least one through opening for closely receiving a mounting stud carried by each of said side handrail, said mounting stud defining a pin receptor at a distal end thereof for receiving a locking pin, said side handrail including at least one mounting brace pivotally secured at a proximal end thereof to said side handrail, said mounting brace defining a locking pin at a distal end thereof, said rearward post and said forward post each defining at least one receptor for closely receiving said mounting brace locking pin, said side handrail mounting stud pin receptor being disposed such that when said handrail mounting stud is received within said through opening, said locking pin is received with said pin receptor, and said mounting brace locking pin is received within said mounting brace locking pin receptor, said mounting brace is tensioned to bias said side handrail away from said end frame;

a ladder carried by said center post, an eye bolt carried at said upper end of said center post for receipt of a conventional safety cable; and at least one electrical outlet carried by said center post, electrical wiring being disposed within said center post for electrical communication between said at least one outlet and a power source, a plurality of walk boards, each said walk board defining a plurality of mounting studs at a proximal end and a distal end thereof, said plurality of mounting studs being disposed and configured to be closely received within said plurality of receptors defined by said walk board support; and a plurality of work boards, each said work board defining a plurality of mounting studs at a proximal end and a distal end thereof, said plurality of mounting studs being disposed and configured to be closely received within said plurality of receptors defined by said work board support.

14. The improved scaffolding of claim 13 wherein said walk board support is permanently secured to said forward post and said center post, and wherein said work board support is permanently secured to said center post and said rearward post.

15. The improved scaffolding of claim 13 wherein said walk board support is removably secured to said forward post and said center post, and wherein said work board support is removably secured to said center post and said rearward post.

16. The improved scaffolding of claim 13 wherein said electrical wiring terminates at an upper end and a lower end of said center post with one each of said at least one electrical outlet, said improved scaffolding further comprising at least one electrical jumper configured to connect said electrical wiring of one said end frame center post with another said end frame center post in order to establish electrical communication therebetween.

17. The improved scaffolding of claim 13 wherein said rearward post defines one said through opening at each of said upper end and said lower end thereof and wherein said forward post defines one said through opening proximate said upper end thereof, said side handrail being removably securable at each said through opening.

18. The improved scaffolding of claim 13 wherein said walk board proximal end and said walk board distal end are disposed in parallel relationship one with another, and wherein said work board proximal end and said work board distal end are disposed in parallel relationship one with another.

19. The improved scaffolding of claim 1 wherein said walk board proximal end and said walk board distal end are disposed at a right angle with respect to each other, and wherein said work board proximal end and said work board distal end are disposed at a right angle with respect to each other.

* * * * *

UNITED STATES PATENT AND TRADEMARK OFFICE

CERTIFICATE OF CORRECTION

PATENT NO : 5,810,114

DATED : September 22, 1998

INVENTOR(S) : Bethel Y. White

It is certified that error appears in the above-identified patent and that said Letters Patent is hereby corrected as shown below:

At Column 2, line 26, insert a period --.-- after "thereof" and start a new a paragraph beginning with the word "Yet".

At Column 2, lines 47 and 62, Col. 4, lines 47 and 67, and Col. 7, line 56, insert a period --.-- after thereof.

At Column 10, lines 3 and 24, insert a semicolon --;-- after the word "post".

At Column 10, line 30, insert a semicolon --;-- after the word "source".

At Column 11, line 5, delete "1" and insert therefor --13--.

Signed and Sealed this

Twenty-third Day of February, 1999

*Attest:*

Q. TODD DICKINSON

*Attesting Officer*

*Acting Commissioner of Patents and Trademarks*